US005589094A

United States Patent [19]

Bu

[11] Patent Number: 5,589,094

[45] Date of Patent: Dec. 31, 1996

[54] MICROWAVE OVEN EMPLOYING THERMOPILE TYPE SENSOR

[75] Inventor: Jong U. Bu, Seoul, Rep. of Korea

[73] Assignee: Goldstar Co., Ltd., Seoul, Rep. of Korea

[21] Appl. No.: 406,507

[22] Filed: Mar. 20, 1995

[30] Foreign Application Priority Data

Mar. 18, 1994 [KR] Rep. of Korea ..... 5485/1994

[51] Int. Cl.[6] ..... H05B 6/68

[52] U.S. Cl. ..... 219/711; 219/710; 219/494; 374/124; 374/149

[58] Field of Search ..... 219/711, 710, 219/494, 510; 374/110, 120, 121, 126, 130, 132, 149; 99/325

[56] References Cited

U.S. PATENT DOCUMENTS

| | | | |
|---|---|---|---|
| 4,286,134 | 8/1981 | Nakata et al. | 219/711 |
| 4,347,418 | 8/1982 | Nobue et al. | 219/711 |
| 4,401,884 | 8/1983 | Kusunoki et al. | 219/492 |
| 4,499,357 | 2/1985 | Kojima | 219/711 |
| 4,614,441 | 9/1986 | Wolf | 374/121 |
| 4,636,091 | 1/1987 | Pompei et al. | 374/124 |
| 4,679,948 | 7/1987 | Hempowitz et al. | 374/129 |
| 4,722,612 | 2/1988 | Junkert et al. | 374/124 |
| 4,751,356 | 6/1988 | Fukuda et al. | 219/711 |
| 5,033,866 | 7/1991 | Kehl et al. | 374/179 |
| 5,235,148 | 8/1993 | Yamaguchi et al. | 219/10.55 B |
| 5,281,786 | 1/1994 | Park | 219/10.55 M |

*Primary Examiner*—Philip H. Leung
*Attorney, Agent, or Firm*—Faegre & Benson

[57] ABSTRACT

This invention is related to a sensor for detecting food temperature, which can control cooking more precisely by detecting change of food temperature utilizing the heat absorption rate difference of black bodies and non-black bodies to permit cooking control when cooking below boiling point, such as thawing or warming up.

10 Claims, 5 Drawing Sheets

MICROWAVE OVEN EMPLOYING THERMOPILE TYPE SENSOR

FIELD OF THE INVENTION

This invention relates to a microwave oven, more particularly to a microwave oven which allows precise cooking control by remote detection of the temperature of food being cooked using a thermopile type sensor.

BACKGROUND OF THE INVENTION

Microwave ovens having automatic cooking control features are widely used because they make cooking more convenient and simple. Various types of sensors have been used in prior art microwave ovens that have automatic cooking functions.

The types of sensors which previously have been used in such microwave ovens are sensors for detecting temperature, sensors for detecting the humidity level, sensors for detecting vapor generated by cooking, and sensors for detecting the weight of food inside of the oven. However, microwave ovens that employ only these types of sensors have a limit in their ability to detect precise cooking conditions.

For example, even though various automatic cooking control functions are available using humidity detection sensors (especially the absolute humidity detection sensors that are widely used for automatic cooking control of microwave ovens), these prior art sensors cause problems when cooking under low heat. Specifically, when warming up food or thawing meat or fish, it is difficult to properly control cooking based on humidity detection because the quantity of moisture generated throughout the entire cooking process is very small.

Furthermore, when using a single container to successively thaw multiple pieces of meat or fish, prior art ovens that employ a humidity sensor often malfunction due to vapor being generated by the premature boiling of residual water left over from the previous thawing operation. As these vapors are not indicative of the current thawing process, they falsely indicate the status of the current thawing process. In order to reduce the frequency of this problem, manufacturers have attempted to explain in the owners' manual the necessity of fully cleaning and drying a container before using that container to thaw a new piece of food. Such efforts, however, may have the undesirable side effect of making microwave thawing cumbersome and inconvenient.

Other prior art microwave ovens employ sensors for directly detecting the temperature of the food being cooked. Despite the advantages offered by the precise detection of the cooking conditions, there are several disadvantages to the temperature sensor directly contacting the food, including the possibility of giving users a feeling of uncleanliness, hygiene concerns and the inconvenience of manipulating the sensor into the food.

Accordingly, a remote method for sensing the food temperature is desired. One example of such a prior art technique uses pyroelectric infrared sensors. Using pyroelectric infrared sensors for continuous temperature sensing, however, requires a mechanically driven chopper for polarization. This complicates the construction and increases manufacturing costs. Additionally, such devices are difficult to apply in practical applications.

SUMMARY OF THE INVENTION

This invention is directed to a microwave oven employing a thermopile type sensor which provides for precise cooking control by detecting changes in the temperature of food being cooked. The temperature is detected by sensing the heat radiation emitted from the food, or the wrapping enclosing the food, and by taking advantage of the heat absorption properties of a black body.

A further object of this invention is to provide a microwave oven employing a thermopile type sensor which can prevent malfunctions in cooking control when cooking at temperatures below the boiling point of water, such as thawing or warming up food.

A microwave oven comprises an outer case and a cavity. The cavity has an upper and a lower case facing each other, wherein the upper case has an opening therein, and a right and a left side case facing each other. A rotatable turntable adapted for holding food is mounted to the lower case opposite the opening in the upper case, and a motor is mounted under and is operably connected to the turntable for rotating the turntable. A magnetron device is mounted to the side case of the cavity for generating microwaves for the cavity, and a cooling fan is mounted on the side case under the magnetron device for cooling the air in the cavity.

A thermopile type sensor is mounted in the opening of the upper case of the cavity in packaged form. The sensor is used for sensing the radiation temperature of the food placed on the turntable by utilizing the absorption rate difference between a black body and a non-black body on radiation heating. The thermopile type sensor produces an analog output value which is converted to a digital output by an A/D converter electrically connected thereto. A microcomputer receives the digital output of the A/D converter and controls automatic cooking according to the output of the A/D converter. This is effectuated by sending an output signal to a power supply part, which in turn operates the magnetron device and the cooling fan to automatically heat food placed on the turntable according to the output of the microcomputer.

The thermopile type sensor includes a substrate having a membrane structure, a first insulation layer and a second insulation layer successively formed thereon. Two thermocouples formed on the second insulation layer are connected in series. Each thermocouple has a hot junction and a cold junction. The thermopile type sensor further includes a temperature sensor formed at one side of the second insulation layer. The thermopile type sensor further comprises a third insulation layer and a black body formed on the third insulation layer over the hot junctions.

In general, the radiation rates of organic and inorganic materials (except metal and glass) are in most cases over 60%. According to Wien's law, radiation intensity is proportional to the fourth power of the temperature, and thus the radiation intensity increases sharply as surface temperature of food rises. This property is used to facilitate precise automatic cooking control.

DETAILED DESCRIPTION OF THE INVENTION

Figure 1:
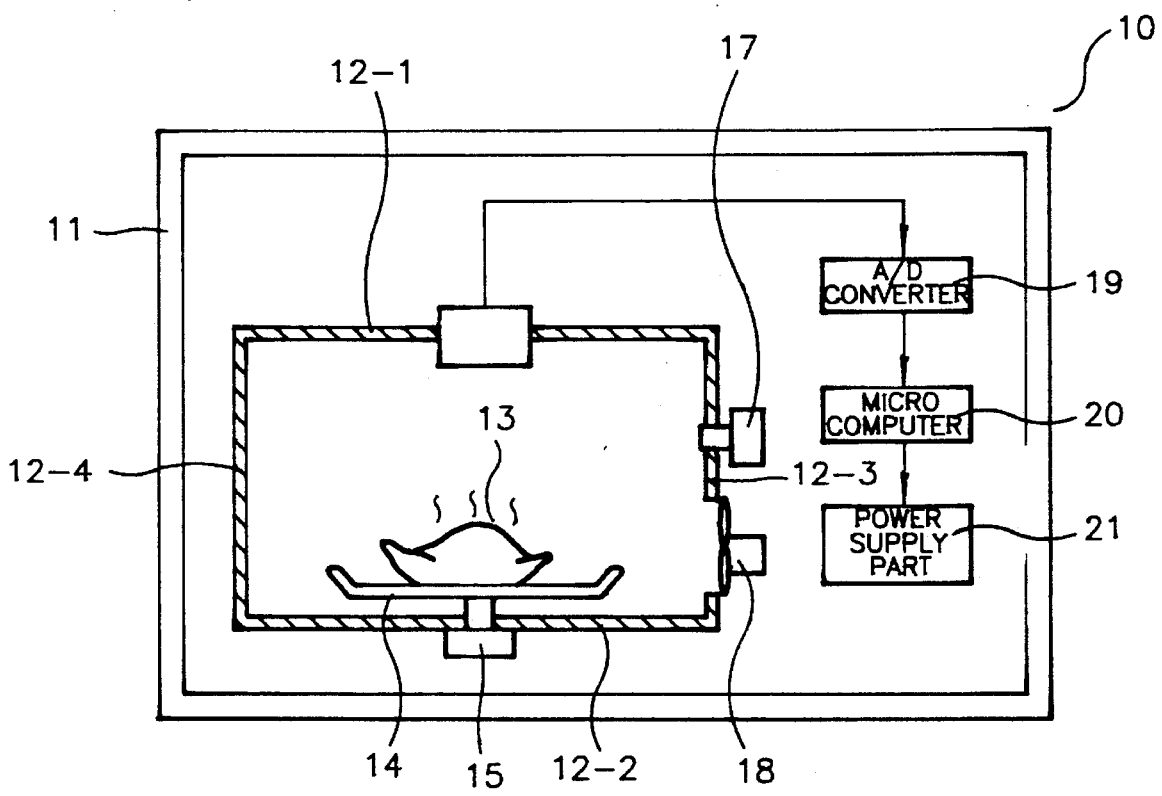
FIG. 1 is a section view of a microwave oven in accordance with one embodiment of this invention.

As shown in FIG. 1, a microwave oven 10 in accordance with this invention includes an outer case 11 and an inner case (or cavity) 12 located therein. The inner case 12 has an upper and a lower case 12*a* and 12*b* and side cases 12*c* and 12*d*. The upper case 12*a* has an opening 25 therein to facilitate temperature sensing, as will be described below. A rotatable turntable 14 is mounted to the lower case 12*b*, opposite the opening 25, and is operably connected to a motor 15 which rotates the turntable 14. As is known in the art, placing food 13 on the rotating turntable 14 more evenly cooks the food.

A magnetron device 17, which generates microwaves for the cavity 12, is mounted on the side case 12*c* of the inner case 12. A cooling fan 18 is mounted on the side case 12*c* under the magnetron device 17 and is used to cool the air in the cavity 12. It should be understood that the forementioned parts of the microwave oven 10 need not differ from prior art ovens.

A thermopile type sensor 16 is mounted in the opening 25 of the cavity 12 for sensing the radiation temperature of the food 13 placed on the turntable 14. As is more fully described below, the thermopile type sensor 16 works by taking advantage of the absorption rate difference of radiation heating between a black body and a non-black body. The thermopile type sensor 16 produces an analog output which corresponds to the temperature of the food 13 sensed by the thermopile type sensor 16. This analog output is fed into an analog/digital (A/D) converter 19 which is electrically connected to sensor 16. The A/D converter 19 converts the output value of the thermopile type sensor 16 from analog to digital. The A/D converter 19 is electrically connected to a microcomputer 20, and the digital output of the A/D converter 19 is inputed into the microcomputer 20. A power supply part 21, which receives input from the microcomputer 20, is electrically connected to and controls the magnetron device 17 and the cooling fan 18. Thus, the microcomputer 20 controls heating time period of the food 13 according to the method of cooking desired and selected by a user, such as warming or thawing, by utilizing the food temperature sensed by the thermopile type sensor 16. The output from the microcomputer 20 is applied to the power supply part 21, and the power supply part 21 operates the magnetron device 17 and the cooling fan 18 according to the output from the microcomputer 20 to make a precise automatic cooking control possible.

Figure 2:
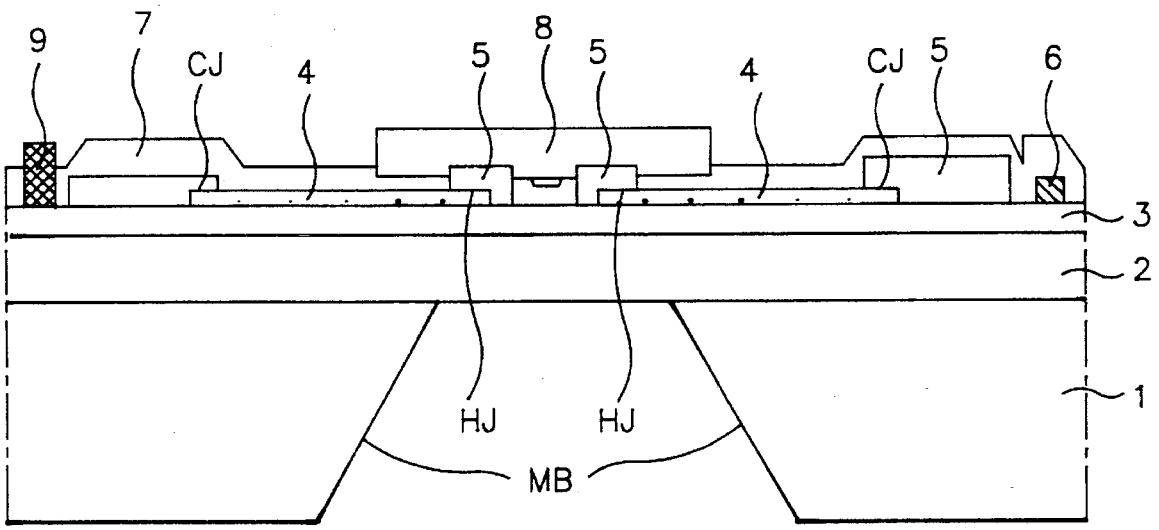
FIG. 2 is a section view of the thermopile type sensor of the microwave oven of FIG. 1.

Referring now to FIG. 2, the sensor 16 for detecting food temperature in accordance with this invention is a micro-thermopile type sensor formed of silicon. The sensor 16 includes a silicon substrate 1 having a membrane structure with a first insulation layer 2 and a second insulation layer 3 formed successively thereon. The first insulation layer 2 is preferably a nitride film, and the second insulation layer 3 is preferably of oxide film.

Two spaced apart first thermoelectric elements 4 are formed on the second insulation layer 3. Second thermoelectric elements 5 are formed adjacent to each opposite end of each first thermoelectric element 4 and extend slightly over the end thereof and thereabove. A first thermoelectric element 4 and the adjacent two second thermoelectric elements 5 together form a thermocouple. Although the two thermocouples are shown separated from each other in FIG. 2, the thermocouples are actually electrically connected in series to form a thermopile structure.

In the preferred embodiment, the first thermoelectric elements 4 are formed from polysilicon film doped with boron, preferably in a density of about $1\times10^{19}$ atoms/cm$^3$, and the second thermoelectric elements 5 are formed from a metal membrane, preferably aluminum. The thermoelectric elements 4 and 5 may also be made of other materials, such as, for example, an alloy of bismuth or tellurium having a great See back effect, or alloy of constantan. These other materials, however, have a drawback in that it is more difficult to form the membrane.

The thermopile type sensor 16 further includes a temperature sensor 6 formed on the second insulation layer 3 at one end thereof and separated from the nearby second thermoelectric element 5. At the opposite end of the second insulation layer 3 is a wire bonding pad 9 which is separated from the nearby thermoelectric element 5.

A third insulation layer 7 is coated over the first and second thermoelectric elements 4 and 5, the temperature sensor 6, around the wire bonding pad 9, and over uncovered portions of the second insulation layer 3. The wire bonding pad 9 and the middle two second thermoelectric elements 5 protrude above the third insulation layer 7.

A black body 8 for absorbing radiation heat from the food 13 being heated in the microwave oven 10 is then formed. The black body 8 is formed on the top the middle two second thermoelectric contracts 5 (which are not covered by the third insulation layer 7) and extends laterally outward over the third insulation layer 7 and portions of the first thermoelectric elements 4 therebelow. The black body 8 can be formed, for example, of gold black, platinized platinum, a diamond membrane or a carbon membrane.

The substrate 1 has a back side 32 which is the portion of the substrate 1 over which the black body 8 has been formed. The back side 32 is etched, forming a membrane structure MB for thermal isolation. As shown in FIG. 2, the thermopile type sensor 16 preferably has a diaphragm structure.

The portions of each of the first thermoelectric elements 4 and the second thermoelectric elements 5 which contact each other over the membrane structure MB (i.e., the middle two second thermoelectric elements 5) form a hot junction HJ, and the portions of each of the first thermoelectric elements 4 and the second thermoelectric elements 5 which contact each other over either side of the membrane structure MB (i.e., the outer two second thermoelectric elements 5) form a cold junction CJ, as shown in FIG. 2.

Figure 4:
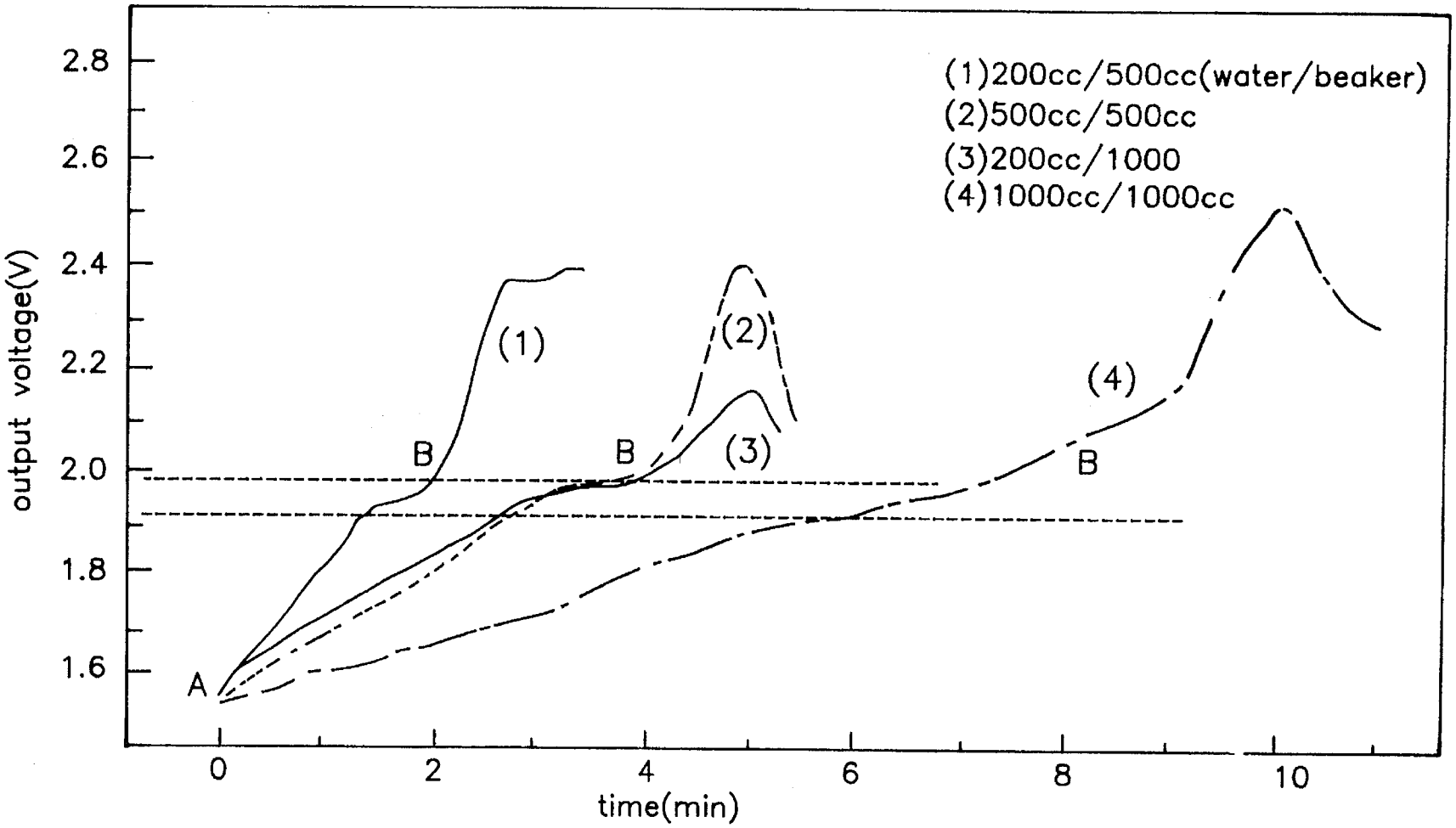
FIG. 4 is a sample output wave pattern of the thermopile type sensor of FIG. 2.

FIG. 4 shows a sample output wave pattern of the thermopile type sensor 16 resulting from actual heating, as well as output wave patterns resulting from tests using water loads. When the sensed temperature is between point A (the initial temperature) and point B (the boiling temperature of water), the output voltage of the sensor 16 shows a linear increase over time corresponding to the temperature of water. When the sensed temperature reaches point B, however, a sharp increase in the output voltage of the sensor 16 occurs due to a sharp effusion of vapor from water boiling.

When the microwave oven 10 is used for general cooking (i.e., cooking that does not include thawing or warming up), an algorithm can be formulated to enable the microcomputer 20 to carry out an appropriate cooking control according to the detected time point of initial water boiling based on the sharp increase in output voltage of the sensor 16 detected at point B. On the other hand, when using the microwave oven 10 for heating that ends before start of boiling of water, such as thawing or warming up, automatic control can be accomplished by selecting an appropriate heating end point C which is located between point A and point B.

The change of the food temperature is difficult to sense during the initial stages of heating, including during the initial stage of thawing. As thawing proceeds, however, the temperature of the surface of the food 13 being cooked rises more rapidly than the temperature of the inside of the food 13 due to a water film forming on the surface of the food 13. Accordingly, the output signal of the sensor 16 rises slowly once this water film forms, and then rises rapidly once vaporization of the water film begins.

As heating continues, the output signal continues to rise, but does so at a decreased rate. This is because the temperature difference between the hot junctions HJ and the cold junctions CJ decreases due to rise of the temperature inside of the cavity 12, which is in turn caused by the vapor generated by the food 13 and the subsequent transfer of heat to the air. As heating continues, the thawing process is completed when the output voltage reaches point C (located at an appropriately selected point between point A and point B), as can be seen from the changes in the output signal shown in FIG. 4. Thus, it is possible to properly control the actual cooking period when thawing or warming up by detecting the point C.

Another embodiment of this invention (not shown) uses a radiation heat detection sensor instead of the more complicated thermopile type sensor. A radiation heat detection sensor utilizes two structures, preferably copper membranes, but alternatively they can be structures made of other metals which have excellent heat conductivity properties. One of the membranes is coated with a black body and the other one is processed for non-blackening. Each of the metal structures should be designed to form a tightly enclosed space in which thermistors, thermocouples and resistance type temperature sensors are placed for detecting the temperature from inside. In this embodiment, the radiation heat detection sensor utilizes an inside temperature difference between a blackened structure and a non-blackened structure. For example, when heat radiation is first applied to the sensor, the temperature difference between the blackened structure and the non-blackened structure at first increases due to the blackened structure absorbing heat faster than the non-blackened structure. This temperature difference decreases as the non-blackened structure also absorbs heat, converging to zero after long period of time. Thus, if the point at which the difference in temperature reaches a maximum is used as a basis of control, it is possible to control the cooking.

Figure 3:
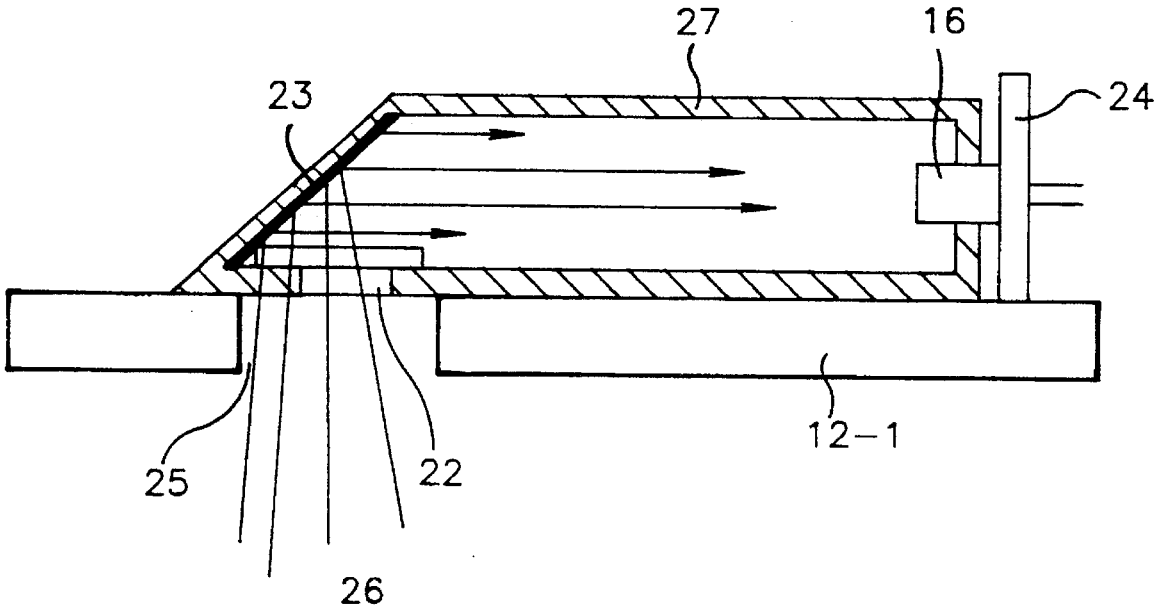
FIG. 3 is an enlarged fragmentary view of an alternative embodiment of this invention, particularly showing a sensor module.

Now turning to the placement of the sensor on the oven, FIG. 3 shows an alternative embodiment to that of FIG. 1. This embodiment incorporates a sensor module 28 having a thermopile type sensor 16. The module 28 could alternatively use another type of sensor, such as, for example, the previously described radiation heat detection sensor.

The module 28 is mounted above the upper case 12*a* and is positioned on the opening 25 therein, as will be described below. The module 28 is preferable an elongated horizontal structure with a sensing opening 29 near one end thereof. The sensing opening 29, which is preferably smaller than the opening 25 of the upper case 12*a*, is positioned over the opening 25. At the opposite end of the module 28 is a sensor 16. The sensor 16 preferably is mounted to a mounting structure 24 which is secured to the upper case 12*a*, wherein the sensor 16 passes through an opening 30 in the sidewall of the module 28. Alternatively, the sensor 16 could be mounted directly to the module 28.

At the end of the module 28 opposite the sensor 16, namely at the end with the sensing opening 29, the module 28 has an end 31 angled at substantially 45° relative to a vertical axis. This angled end 31 redirects incoming radiation heat 26 towards the sensor 16.

Because the sensor module 28 is a package with the sensing opening 29 offset from the sensor 16, the module 28 is not positioned directly opposite the center of the turntable 14 (as was done in embodiment shown in FIG. 1). Instead, in the embodiment shown in FIG. 3, the sensing opening 29 of the module 28 is fitted over the opening 25 in the upper case 12*a* of the cavity 12.

The interior sidewalls of the sensor module 28 function as a reflector assembly 27 and are preferably formed of heat resistant plastic. A reflector 23 is preferably mounted on the inward side of the end 31 to reflect and direct the radiation heat 26 toward the sensor 16. The reflector 23 is made by putting a metallic glossy coating on inside of the end 31. The sensor 16, which is placed at the opposite end of the reflector assembly 27, faces the reflector 23.

Figure 5:
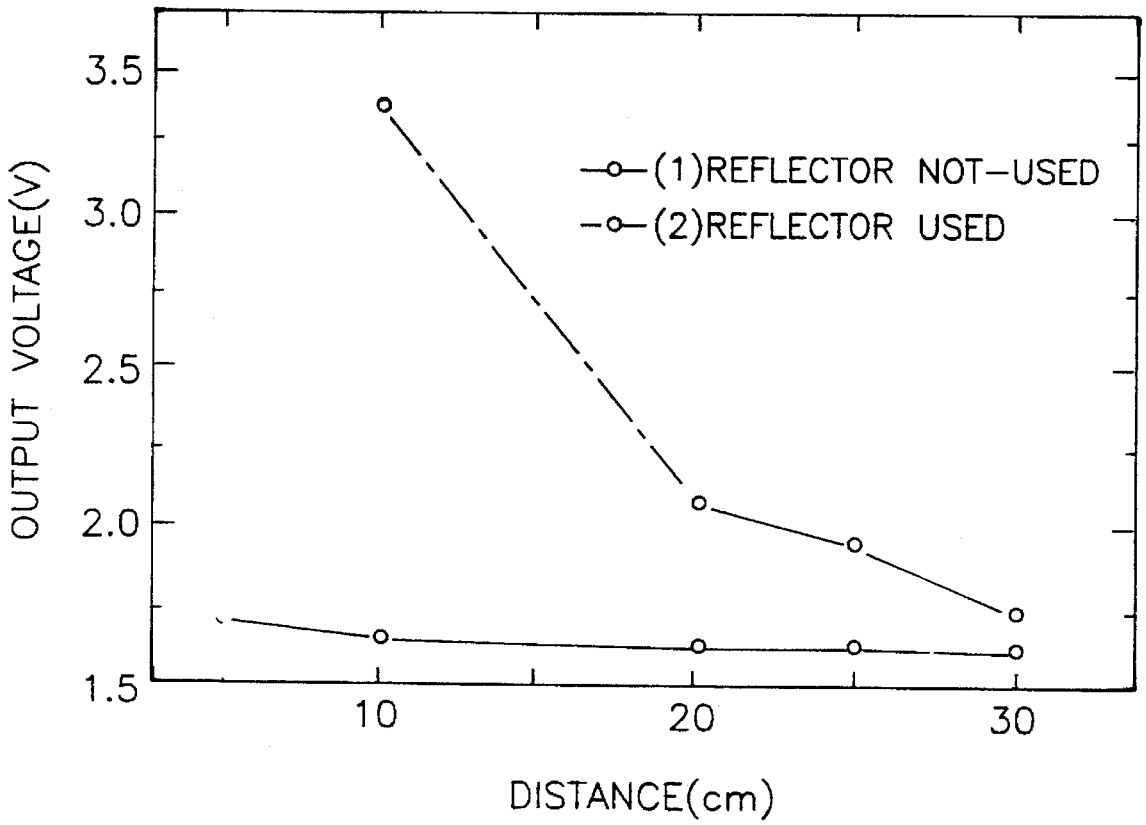
FIG. 5 is a sample output wave pattern of the sensor module of FIG. 3 when used with and without a reflector.

As previously mentioned, the reflector 23 focuses the weak radiation heat filtered by the filter 22 onto the sensor 16. FIG. 5 shows a sample output characteristics of the module 28 both with and without the presence of the reflector 23. The vertical axis depicts the output voltage of the sensor 16, while the horizontal is the distance between the filter 22 and the turntable 14. As is readily evident from the graph shown in FIG. 5, the effect of reflector 23 is significant for certain distances between the filter 22 and the turntable 14. Therefore, even though the sensor 16 not directly opposite the turntable 14, it is possible to obtain the same sensing effect using this configuration as would be obtained if the sensor 16 was positioned directly opposite the center of the turntable 14.

A filter 22 is preferably secured within the sensing opening 29, and is positioned directly over the center of the turntable 14. The filter 22 greatly reduces the chances of a malfunction caused by contamination. Also, the problems of pollution stemming from the rapid effusion of vapor or emissions of oil from cooking interfering with the sensor can be minimized by using the sensor module 28 shown in FIG. 3. In this arrangement, the filter 22 filters the radiation heat only when it is emitted together with filterable materials, such as oil, or when the filter 22 is greatly affected by the vapor generated during cooking. Furthermore, the filter 22 or the reflector 23 can be formed to function as a lense to focus radiation onto the sensor 16 and compensate for the greater distance between the sensor 16 and the food 13.

As has been explained, this invention has advantages of facilitating control of all kinds of cooking because it can carry out precise cooking control in cookers such as microwave ovens and can prevent the cooker from malfunctioning even when cooking below boiling point of water, such as thawing and warming up, by detecting state of temperature change of food.

Although the invention has been described in conjunction with specific embodiments, it is evident that many alternatives and variations will be apparent to those skilled in the art in light of the foregoing description. Accordingly, the invention is intended to embrace all of the alternatives and variations that fall within the spirit and scope of the claims.

What is claimed is:

1. A microwave oven comprising;

an outer case;

a cavity having an upper and a lower case facing each other, and a right and a left side cases facing each other, and an opening in the upper case;

a table mounted on the lower case opposite the opening, wherein the table is adapted for placing food for cooking thereon;

a thermopile type sensor mounted in the opening of the cavity for sensing a radiation temperature of food placed on the table using an absorption rate difference between a black body on a membrane of the thermopile sensor and a non-black body on radiation heating;

a magnetron device mounted on one of the side cases of the cavity for generating microwaves for the cavity;

a cooling fan mounted on the side case of the cavity under the magnetron device for cooling the air in the cavity;

an A/D converter for A/D converting an output value of the thermopile type sensor;

a microcomputer for receiving an output of the A/D converter and controlling automatic cooking according to the output of the A/D converter; and a power supply part for receiving the output of the microcomputer and operating the magnetron device and the cooling fan to make an automatic cooking of the food placed on the table possible according to the output of the microcomputer.

2. The microwave oven of claim 1, wherein the thermopile type sensor is part of a sensor module, said sensor module includes:

a reflector assembly mounted on the upper case of the cavity;

a filter mounted in the reflector assembly in a position opposite to the opening in the cavity for filtering the radiation heat emitted from food;

a reflector mounted inside the module adjacent to the filter for reflecting radiation heat filtered through the filter; and the thermopile type sensor mounted on the opposite end of the module from the filter and facing the reflector.

3. The microwave oven of claim 2, wherein the reflector assembly is formed of heat resistant plastic.

4. The microwave oven of claim 2, wherein the reflector is formed from metal.

5. A microwave oven comprising;

an outer case;

a cavity having an upper and a lower case facing each other, and a right and a left side cases facing each other, and an opening in the upper case;

a table mounted on the lower case opposite the opening, wherein the table is adapted for placing food for cooking thereon;

a thermopile type sensor mounted in the opening of the cavity for sensing a radiation temperature of food placed on the table using an absorption rate difference between a black body and a non-black body on radiation heating, having:

a substrate having a membrane structure;

a first insulation layer and a second insulation layer formed on the substrate;

a pair of thermocouples formed on the second insulation layer and connected in series, wherein each thermocouple has a hot junction and a cold junction;

a temperature sensor;

a third insulation layer; and a black body formed on the third insulation layer over the hot junctions;

a magnetron device mounted on one of the side cases of the cavity for generating microwaves for the cavity;

a cooling fan mounted on the side case of the cavity under the magnetron device for cooling the air in the cavity;

an A/D converter for A/D converting an output value of the thermopile type sensor;

a microcomputer for receiving an output of the A/D converter and controlling automatic cooking according to the output of the A/D converter;

a power supply part for receiving the output of the microcomputer and operating the magnetron device and the cooling fan to make an automatic cooking of the food placed on the table possible according to the output of the microcomputer.

6. The microwave oven of claim 5, wherein the substrate has a back side which is opposite the black body and which has the membrane structure located thereon.

7. The microwave oven of claim 5, wherein each thermocouple comprises a first thermoelectric element and a pair of second thermoelectric elements.

8. The microwave oven of claim 7, wherein the first thermoelectric elements are formed of polysilicon film doped with boron and each of the second thermoelectric elements are formed of an aluminum membrane.

9. The microwave oven of claim 5, wherein one of gold black, platinized platinum, a diamond membrane, and a carbon film is used for the black body.

10. The microwave oven of claim 5, wherein the first insulation layer and the second insulation layer are formed of a nitride film and an oxide film, respectively.

* * * * *